US011247840B1

(12) United States Patent
Pearce

(10) Patent No.: US 11,247,840 B1
(45) Date of Patent: Feb. 15, 2022

(54) SUCTION BASED TRASHCAN RECEPTACLE AND METHOD OF USE

(71) Applicant: Matthew Lamar Pearce, Lancaster, TX (US)

(72) Inventor: Matthew Lamar Pearce, Lancaster, TX (US)

( * ) Notice: Subject to any disclaimer, the term of this patent is extended or adjusted under 35 U.S.C. 154(b) by 19 days.

(21) Appl. No.: 16/557,514

(22) Filed: Aug. 30, 2019

Related U.S. Application Data

(60) Provisional application No. 62/749,130, filed on Oct. 23, 2018.

(51) Int. Cl.
*B65F 1/06* (2006.01)
*B65F 1/16* (2006.01)
*B65F 1/14* (2006.01)

(52) U.S. Cl.
CPC ..... *B65F 1/068* (2013.01); *B65F 1/065* (2013.01); *B65F 1/1452* (2013.01); *B65F 1/16* (2013.01); *B65F 2220/1066* (2013.01)

(58) Field of Classification Search
CPC .. B65F 1/068; B65F 1/10; B65F 1/105; B65F 1/12; B65F 1/127; B65F 1/1452; B65F 2220/106; B65F 2220/1066; B65D 21/086; B65D 21/083
USPC ..... 220/8, 756, 762, 764
See application file for complete search history.

(56) References Cited

U.S. PATENT DOCUMENTS 5,419,453 A * 5/1995 Lochridge ..... B65F 1/06 220/495.06
6,026,685 A * 2/2000 Weterrings ..... G01F 19/00 220/8
9,828,176 B2 * 11/2017 Kaufman ..... B65F 1/1615
2004/0118850 A1 * 6/2004 Kim ..... B65D 21/086 220/324

* cited by examiner

*Primary Examiner* — Steven A. Reynolds
*Assistant Examiner* — Javier A Pagan
(74) *Attorney, Agent, or Firm* — Leavitt Eldredge Law Firm

(57) ABSTRACT

A suction based trashcan receptacle includes a bottom receptacle body having one or more openings extending at least partially through a thickness of the bottom receptacle body; a top receptacle body to engage with the top open end of the bottom receptacle body; the top receptacle body slides relative to the bottom receptacle body to move from a collapsed position to an extended position; one or more handles having a tension device to allow for the one or more handles to pivot, the one or more handles being secured to the top receptacle; and the one or more handles each having a protrusion to engage with the one or more openings of the bottom receptacle body to secure the top receptacle in the extended position; sliding the top receptacle body to the extended position aids in removing a bag of trash from the trashcan receptacle.

4 Claims, 11 Drawing Sheets

SUCTION BASED TRASHCAN RECEPTACLE AND METHOD OF USE

BACKGROUND

1. Field of the Invention

The present invention relates generally to trashcan systems, and more specifically, to a suction based trashcan receptacle that deploys a method of utilizing the adverse effects of vacuum suction and vacuum release functions to create adherence of a plastic liner disposed and collapses to a lower position to eliminate surface friction for easy removal of a densely packed trash bag. The receptacle configuration collapses and extends with sliding and interlocking means to draw the trash bag to the surface of walls, thereby removing air pockets during its use and lowers the bag half way out of the receptacle.

2. Description of Related Art

Trashcans are well known in the art and are effective means for users to collect their waste for removal from a home or building. For example, FIG. 1 depicts a trashcan 101 having a body 103 with a lid 105. During use, a trash bag (not shown) is secured within the body 103 to collect waste until full, at which time the user will proceed to remove the trash bag for removal from the home or building.

One of the problems commonly associated with system 101 is difficulty removing the full trash bag. For example, as the garbage content increases inside of the bag, the bag traps the air inside the container, thereby reducing the amount of collection/storage space that the total trash bag can contain. The airflow becomes trapped between the bag and the container, causing undesirable air pockets created by a seal formed by the bag around an outer rim of the container. These air pockets can cause the bag to be underutilized and can lead to other difficulties, including the bag slipping into the container or garbage content spilling over. Secondly, trashcan users widely chare the often common hassle of the removal process of fully packed bags, the users often having to lift and pull against a vacuum seal created between the bag and the inner surface of the container. The advantage of the vacuum seal is that the created air suction can pull and hold the bag securely in place, however, this can be disadvantageous during the removal process. During the removal process, the bag can be very heavy and weighted by the garbage content and can be difficult to separate and lift from the container without tearing the bag and leaking garbage into the container or onto the floor.

Accordingly, although great strides have been made in the area of trashcans, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
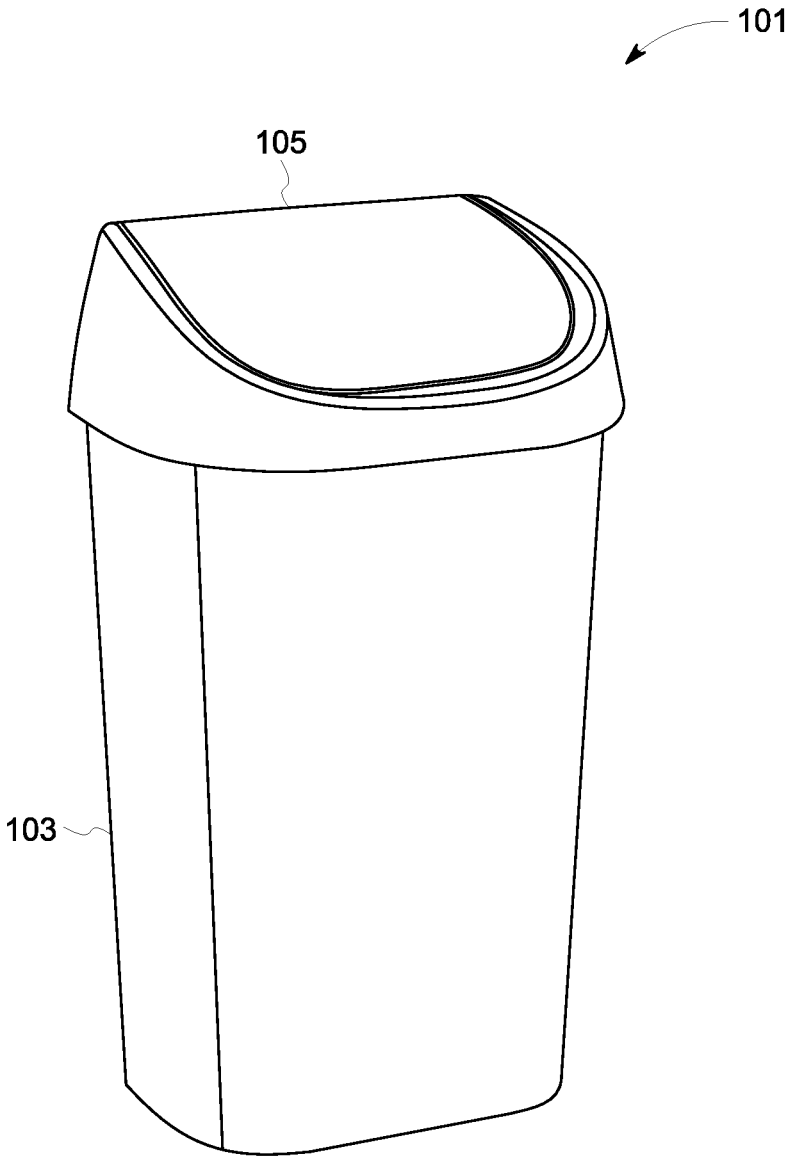
FIG. 1 (PRIOR ART)
FIG. 1 is an isometric view of a common trashcan system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional trashcan systems. Specifically, the present invention provides for a trashcan system that can provide for easier removal of a full trash bag. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
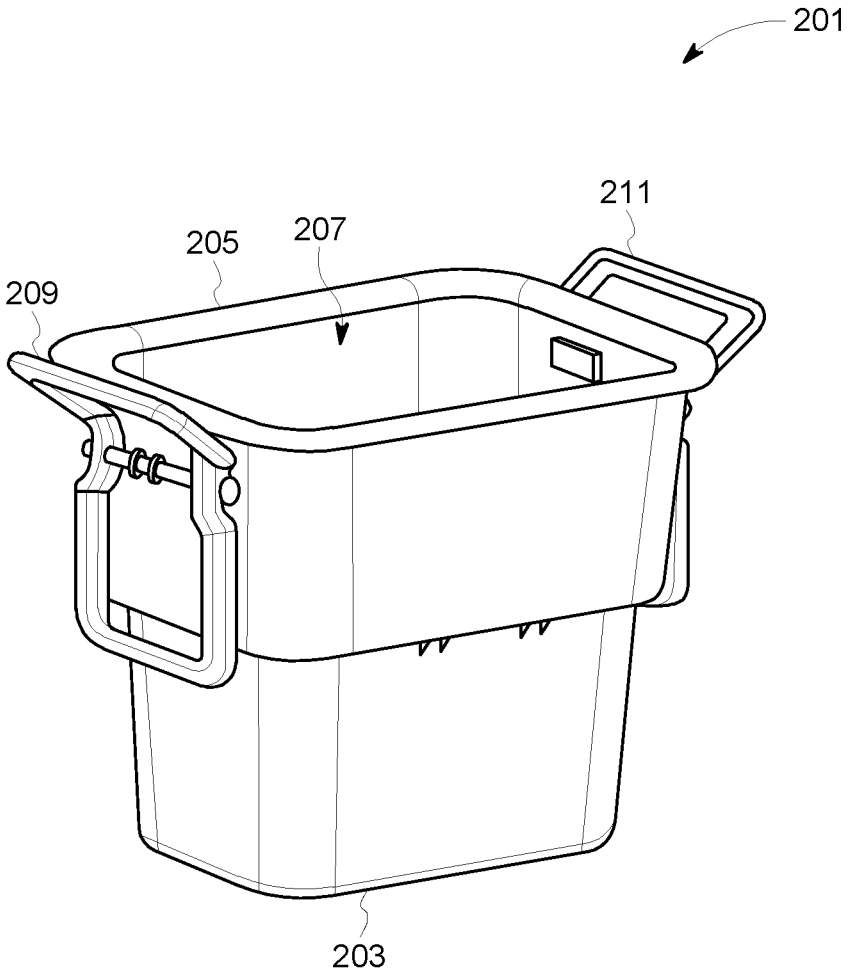
FIG. 2 is an isometric view of a trashcan receptacle in a collapsed position in accordance with a preferred embodiment of the present application.
Figure 3:
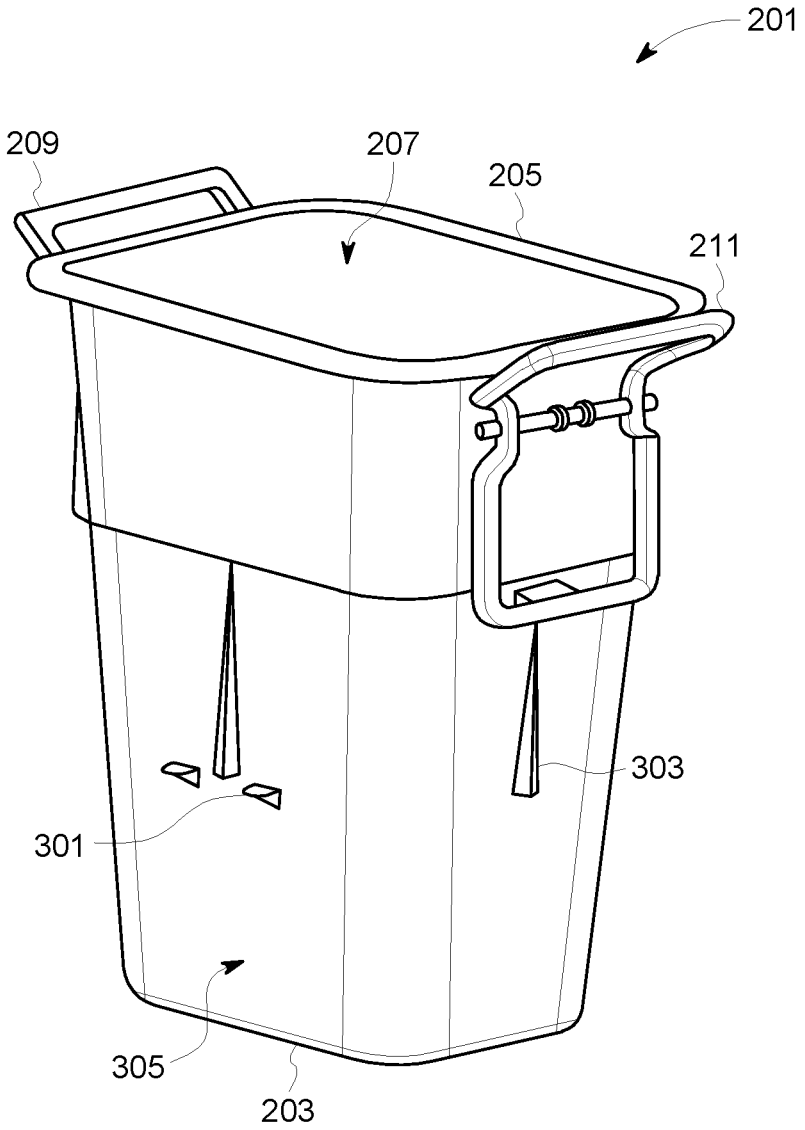
FIG. 3 is an isometric view of the trashcan receptacle of FIG. 2 in an expanded position.

Referring now to the drawings wherein like reference characters identify corresponding or similar elements throughout the several views, FIGS. 2 and 3 depict isometric views of a first embodiment of a trashcan receptacle 201 in a collapsed and expanded position respectively and in accordance with a preferred embodiment of the present application. It will be appreciated that system 201 overcomes one or more of the above-listed problems commonly associated with conventional trashcans.

In the contemplated embodiment, receptacle 201 includes a bottom receptacle body 203 and a top receptacle body 205, wherein the top receptacle body 205 is configured to slidingly engage with the bottom receptacle body 203, thereby extending from a collapsed position (FIG. 2) to an expanded position (FIG. 3). This feature provides for more easy removal of a bag, as will be discussed herein.

Receptacle 201 further includes one or more handles 209, 211 that are configured to aid the user in extending the top receptacle from the bottom receptacle, and further provide for a securing means to secure the receptacle 201 in a collapsed position. The receptacle 201 contains an interior area 207 to receive a trash bag for use. It should be appreciated and understood that the receptacle 201 can vary in materials, size, and shape as aesthetical, functional, or manufacturing considerations require.

As further shown in FIG. 3, bottom receptacle body 203 can further include one or more steps 301 that extend from an exterior surface 305 of the body 203, the one or more steps 301 configured to support the top receptacle body in the collapsed position. In addition, the bottom receptacle body 203 can further include one or more fins 303 extending from the exterior surface 305 and configured to engage with channels (not shown) on the interior surface of the top receptacle body 205, thereby providing for guidance of the top receptacle body relative to the bottom.

Figure 4:
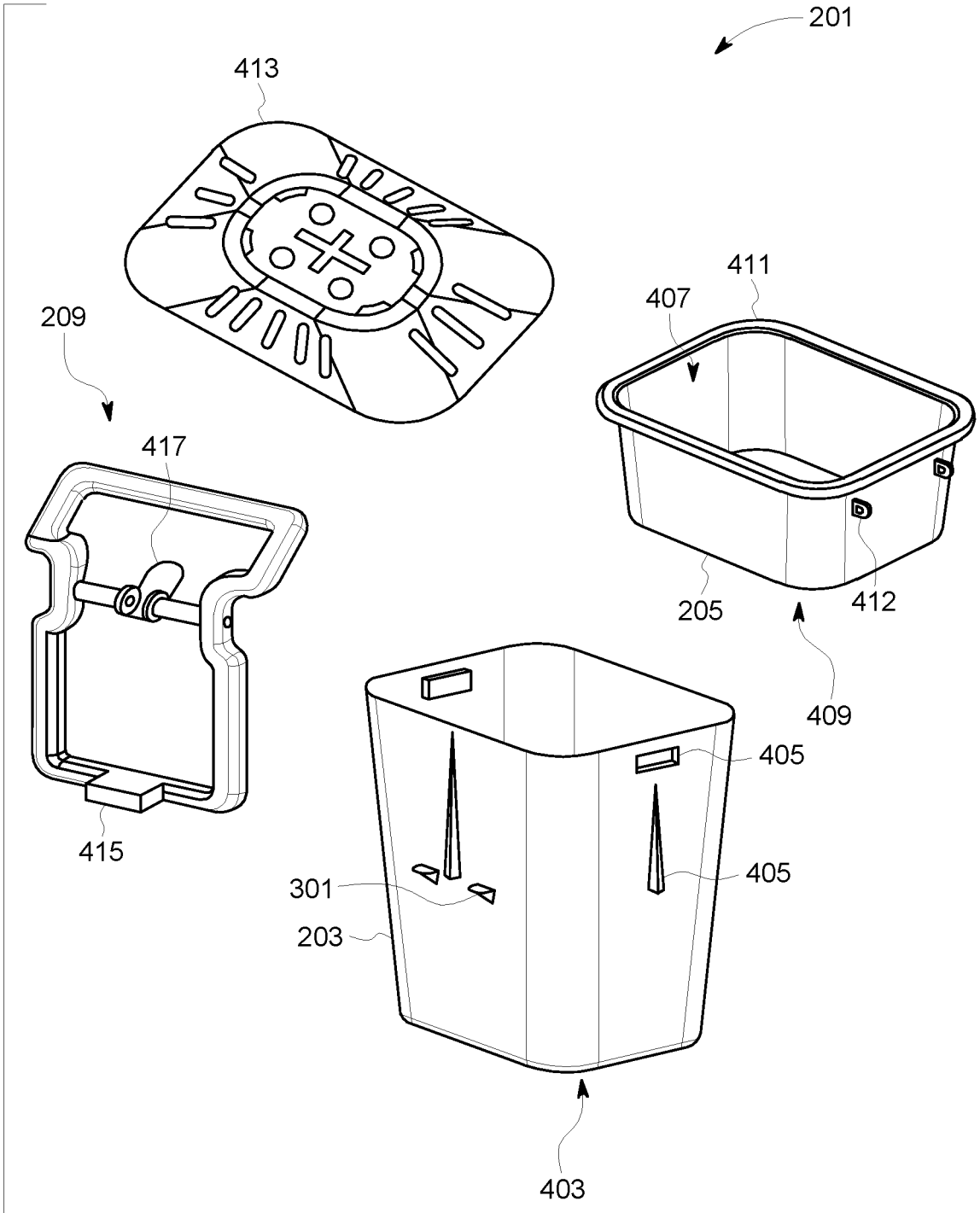
FIG. 4 is a disassembled view of the trashcan receptacle of FIG. 2.

In FIG. 4, the receptacle 201 is further shown in a disassembled view. As shown, the bottom receptacle body 203 extends from an open top end 401 to a closed bottom end 403. Further, the bottom receptacle body 203 can include one or more openings 405 that extend at least partially through the body, thereby providing a location for the one or more handles 209 to engage with.

Further shown in FIG. 4, the top of receptacle body 205 extends from an open top end 407 to an open bottom end 409 and can include a lip 411 for better securement of a trash bag therein. The top receptacle body 205 further includes one or more attachment devices 412 for receiving the one or more handles 209. A lid 413 can further be included and can vary in style and features.

Figure 5:
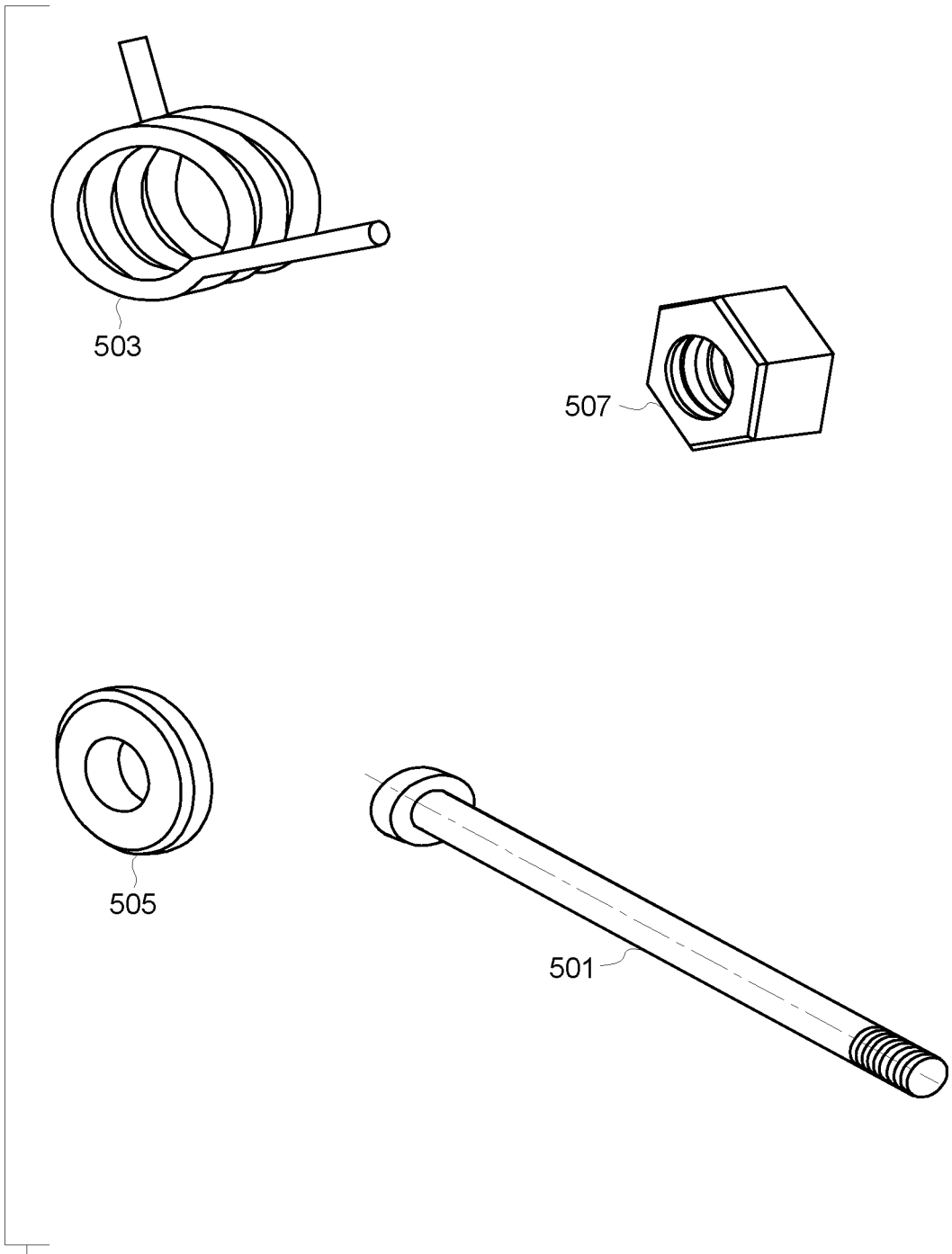
FIG. 5 is disassembled view of some of the components of a handle of the trashcan receptacle of FIG. 2.

Further shown in FIG. 4, handle 209 can include a protrusion 415 for engaging with the one or more openings 405, and can include a tension device 417 such as a spring loaded pin, thereby allowing for pivoting of the handle. In FIG. 5, some of the elements that could make up the handles are shown, including a pin 501, spring 503, a washer 505, and a nut 507.

It should be appreciated that one of the unique features believed characteristic of the present application is the mechanism of the receptacle 201 that allows for easy removal of a trash bag from the receptacle, while still utilizing vacuum suction to secure the sides of the bag to the interior sides of the receptacles.

Figure 6:
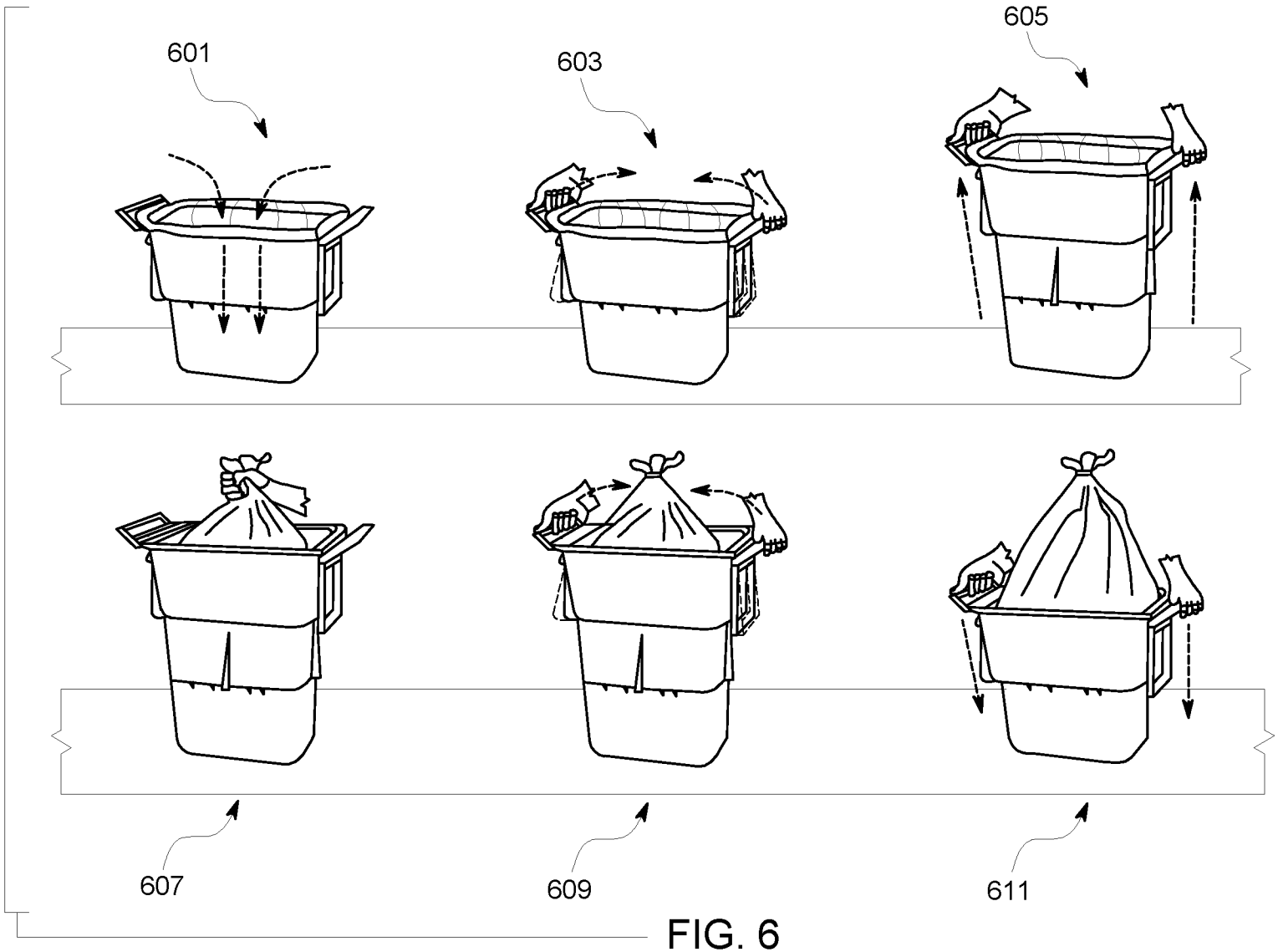
FIG. 6 is a step by step view of the use of the trashcan receptacle of FIG. 2.

In FIG. 6, the steps of use of the present invention are shown. As shown, the first step 601 includes placing the trash bag into the receptacle and securing the trash bag therein, as is known in the art. The second step 603, involves pulling on the one or more handles to release the handles from the collapsed position. The user can then proceed to pull up, shown in step 605, therein the top receptacle body and the bag are pulled upward. The bag can then be removed from the edges of the receptacle and tied/secured, as shown in step 607. The user can then push the top receptacle body back down to the collapsed position, wherein the bag remains extending upward, thereby allowing for less surface area between the bag and the interior of the receptacle, shown in steps 609, 611. The bag therefore becomes easier to remove.

Figure 7:
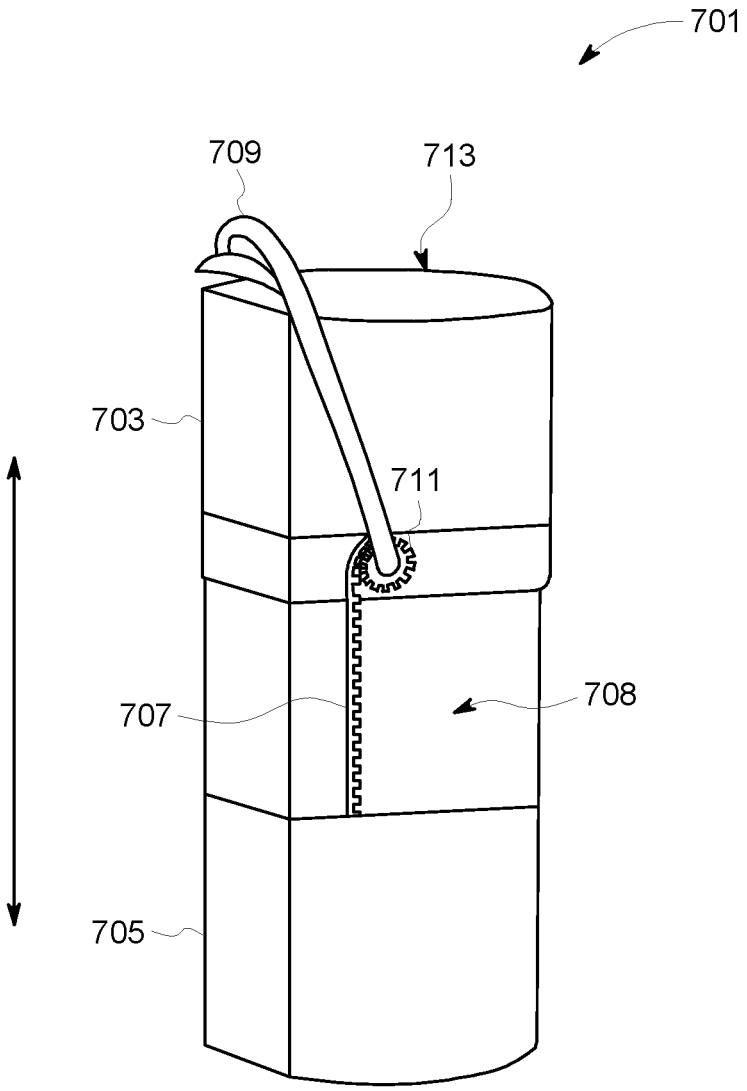
FIG. 7 is a side view of an alternative embodiment of a trashcan receptacle in an expanded position in accordance with the present invention.
Figure 8:
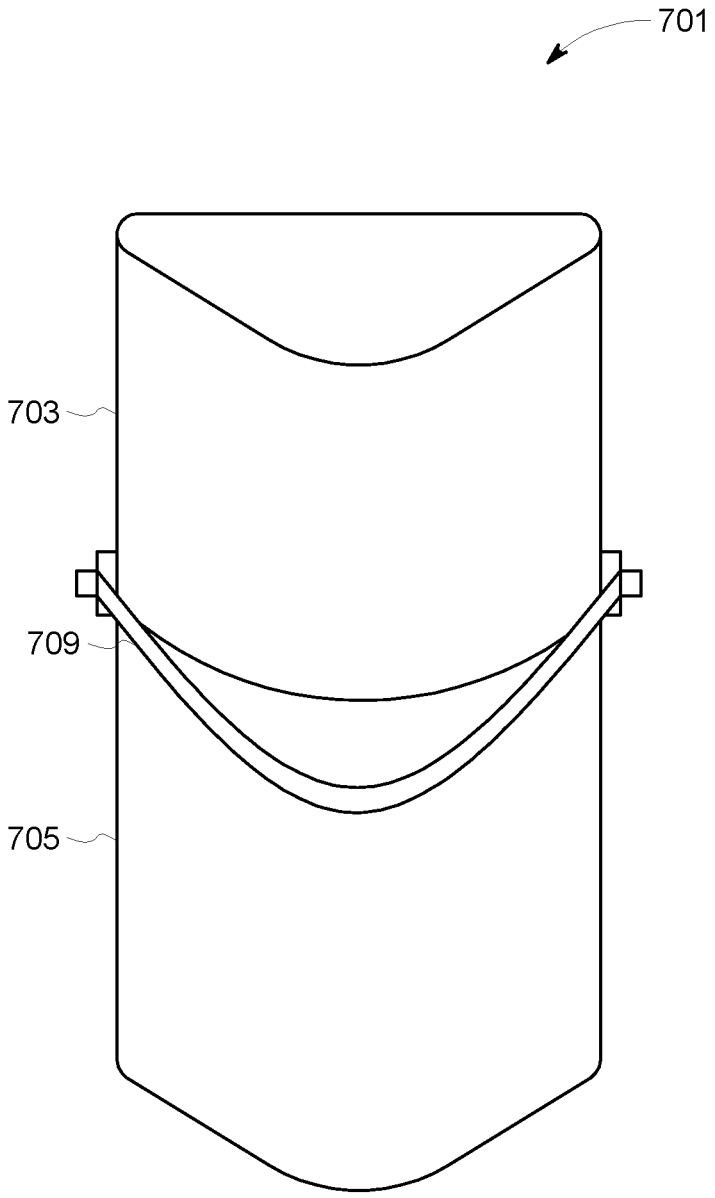
FIG. 8 is a side view of the trashcan receptacle of FIG. 7 in a collapsed position.
Figure 9:
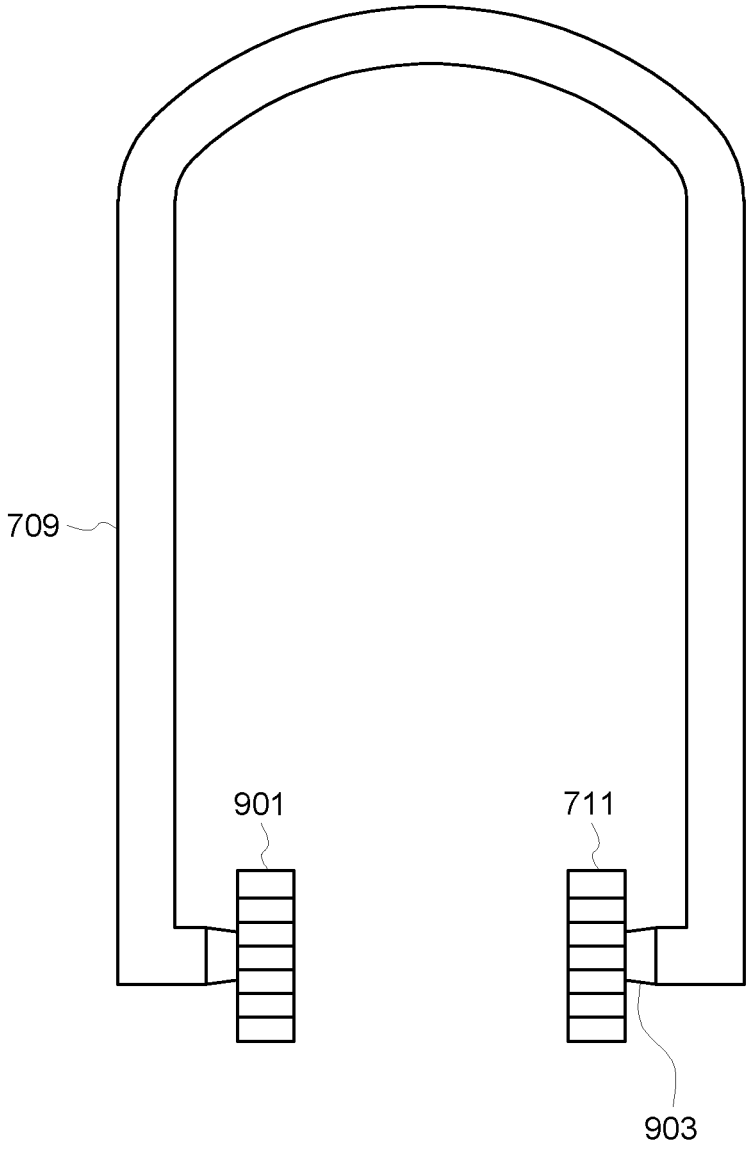
FIG. 9 is a side view of a handle of the trashcan receptacle of FIG. 7.

In FIG. 7-9, an alternative embodiment of a trashcan receptacle 701 in accordance with the present invention is shown. It should be appreciated that the features of the various embodiments can be interchanged. Receptacle 701 includes a top receptacle body 703 and a bottom receptacle body 705 that are slidingly engaged and form an interior area 713. In this embodiment, a gear track 707 is secured to an exterior surface 708 of the bottom receptacle body. A handle 709 is attached to the top receptacle body and provides a means for the user to extend the top receptacle body from the bottom receptacle body. In this embodiment, one or more gears 711 are positioned between the top receptacle body 703 and the bottom receptacle body 705 such that the one or more gears 711 will engage with the gear track 707 during extension of the top receptacle body from the bottom receptacle body.

In FIG. 9, the handle 709 is shown for clarity, wherein two gears 711, 901 are attached thereto, and grooves 903 provide for engagement locations for engaging the handle with the top receptacle body.

Figure 10:
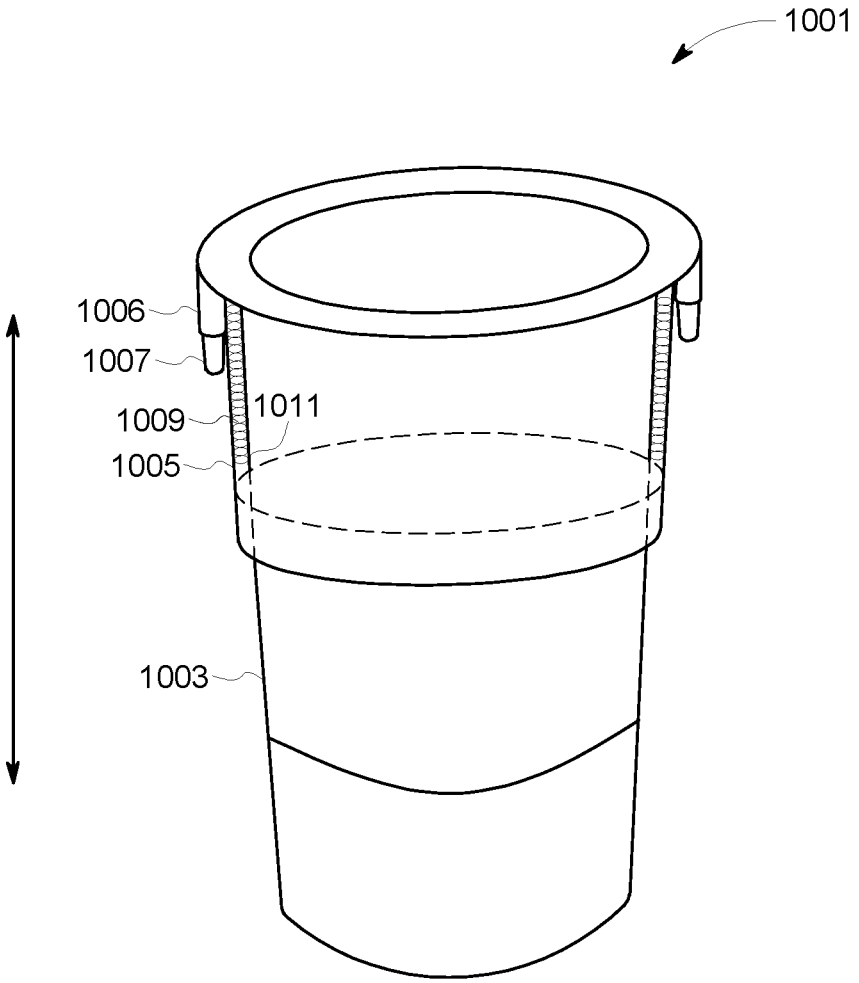
FIG. 10 is a side view of another alternative embodiment of a trashcan receptacle in an expanded position in accordance with the present invention.
Figure 11:
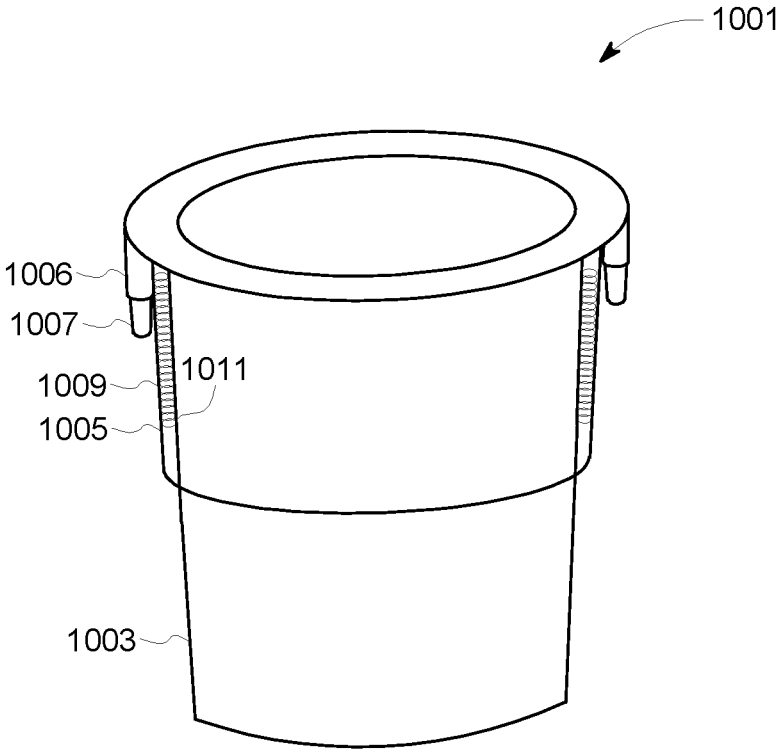
FIG. 11 is a side view of the trashcan receptacle of FIG. 10 in a collapsed position.

In FIGS. 10 and 11, another alternative embodiment of a trashcan receptacle 1001 is shown, having a bottom receptacle body 1003 and a top receptacle body 1005 slidingly engaged therewith. In this embodiment, a handle 1006 is engaged with a spring 1009 within a channel 1011, wherein utilizing a release 1007 will release the spring 1009 from a locked position, thereby allowing for the top receptacle body 1003 to extend from the bottom receptacle body, as shown in FIG. 11.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A suction based trashcan receptacle, comprising:

a bottom receptacle body extending from a top open end to a bottom closed end, the bottom receptacle body having one or more openings extending at least partially through a thickness of the bottom receptacle body;

a top receptacle body having a top open end and a bottom open end, wherein the bottom open end is configured to engage with the top open end of the bottom receptacle body;

the top receptacle body slides relative to the bottom receptacle body to move from a collapsed position to an extended position;

a fin extending from an exterior surface of the bottom receptacle body and configured to engage with and guide the top receptacle body relative to the bottom receptable body;

a plurality of steps attached to and extending away from an exterior surface of the bottom receptacle body, the plurality of steps configured to support the top receptacle body in a collapsed position; and one or more handles having a tension device to allow for the one or more handles to pivot, the one or more handles being secured to the top receptacle; and the one or more handles each having a protrusion to engage with the one or more openings of the bottom receptacle body to secure the top receptacle in the extended position;

wherein sliding the top receptacle body to the extended position aids in removing a bag of trash from the trashcan receptacle.

2. The receptacle of claim 1, further comprising:

a lid configured to secure to the top open end of the top receptacle body.

3. The receptacle of claim 1, wherein each of the one or more handles further comprises:

a pin engaged with the tension device and configured to allow pivoting of the handle.

4. The receptacle of claim 1, wherein the top receptacle body further comprises:

a lip extending around a circumference of the top receptacle body.

* * * * *